US006095596A

United States Patent [19]

Chen

[11] Patent Number: 6,095,596

[45] Date of Patent: Aug. 1, 2000

[54] FOLDING CHAIR STRUCTURE

[75] Inventor: Ting-Hsing Chen, Tainan Hsien, Taiwan

[73] Assignee: Far Great Plastics Industrial Co., Ltd., Tainan Hsien, Taiwan

[21] Appl. No.: 09/377,419

[22] Filed: Aug. 20, 1999

[51] Int. Cl.[7] ..... A47C 4/44; A47C 5/04

[52] U.S. Cl. ..... 297/39; 297/35

[58] Field of Search ..... 297/39, 35, 40, 297/47, 16.1

[56] References Cited

U.S. PATENT DOCUMENTS

| | | | |
|---|---|---|---|
| 1,922,305 | 8/1933 | Kovats | 297/47 |
| 2,649,138 | 8/1953 | Rechler | 297/39 X |
| 2,964,099 | 12/1960 | Panicci | 297/39 X |
| 4,515,389 | 5/1985 | Kassai | 297/35 X |
| 5,054,848 | 10/1991 | Liu | 297/39 |
| 5,529,270 | 6/1996 | Liu | 297/463.1 X |
| 5,735,570 | 4/1998 | Tseng | 297/39 |

FOREIGN PATENT DOCUMENTS

| | | | |
|---|---|---|---|
| 0133940 | 3/1985 | European Pat. Off. | 297/39 |
| 1032291 | 3/1953 | France | 297/35 |
| 1110528 | 10/1955 | France | 5/111 |
| 1414579 | 9/1965 | France | 297/39 |

*Primary Examiner*—Peter M. Cuomo
*Assistant Examiner*—David E. Allred
*Attorney, Agent, or Firm*—Rosenberg, Klein & Lee

[57] ABSTRACT

A folding chair structure includes a fixture and a support with a U-shaped back rod, a seat rod, a rear foot rod and a front foot rod. Wherein, the fixture has a recess and a hole with a pole extending outwardly therefrom. The pole has a cap at the far end. The support has a pair of side walls, one of which side walls has a sliding guide. The back rod is secured into the fixture by inserting one of the two ends into the recess of the fixture. One of the two ends of the seat rod is inserted into the hole of the fixture with the middle portions of two ends of a rear foot rod secured to the support in between the two side walls. And the pole of the fixture is secured in the sliding guide of said support in a sliding manner.

1 Claim, 6 Drawing Sheets

FOLDING CHAIR STRUCTURE

FIELD OF THE INVENTION

This invention relates to the structure of a folding chair, and more particularly to a folding mechanism.

BACKGROUND OF THE INVENTION

The folding chair structure of prior art is composed of a front foot rod engaged with a rear foot rod in a foldable manner. The structure has to bear the entire weight including the person on the chair and the chair itself which will cause the engaging area to loose or even break. That is unsafe and not durable.

In view of this and many other disadvantages, the inventor has invented the present folding structure.

SUMMARY OF THE INVENTION

It is the primary object of the present invention to provide a structure of a folding chair which is safe and endurable.

It is another object of the present invention to provide the structure of a folding chair which is easy to install.

It is a further object of the present invention to provide the structure of a folding chair which is inexpensive in manufacture.

DETAIL DESCRIPTION OF THE PREFERRED EMBODIMENT

Figure 1:
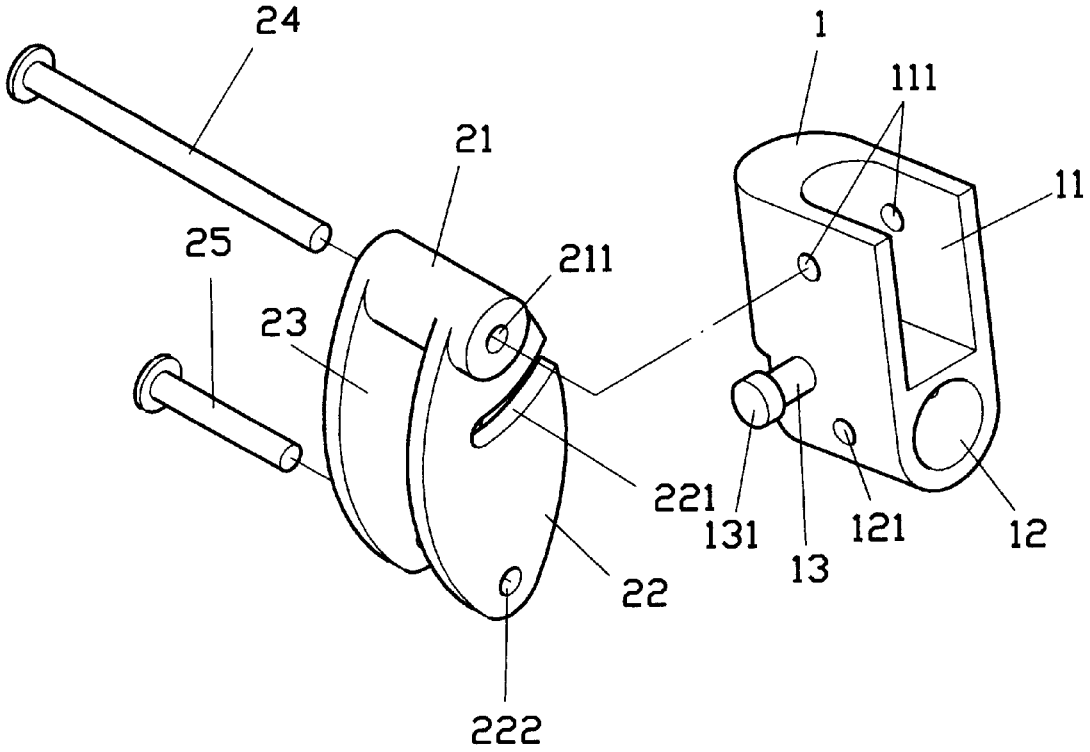
FIG. 1 is an exploded view of a structure of a folding chair of the present invention.

The structure of a folding chair, as shown in FIG. 1, comprises a fixture 1, and a support 2.

The fixture 1 is a block which comprises a recess 11 at its top portion, a hole 12 underneath the recess 11. The recess 11 has a through aperture 111 at each of both sides. A pole 13 extends from a side wall of the fixture 1 with a stop cap 131 at the far end. The hole 12 also has through hole aperture 121 on its side thereof.

The support 2 comprises a stem 21 and a pair of side walls 22 and 23. The stem 21 has an aperture 211 at its top portion. The side wall 22 has a sliding guide 221 in an arc shape at its side. Each of the side walls 22 and 23 is formed with an aperture 222 which corresponds to other members. There are two pins 24 and 25 to be inserted through the apertures 211 and 222, respectively.

Figure 2:
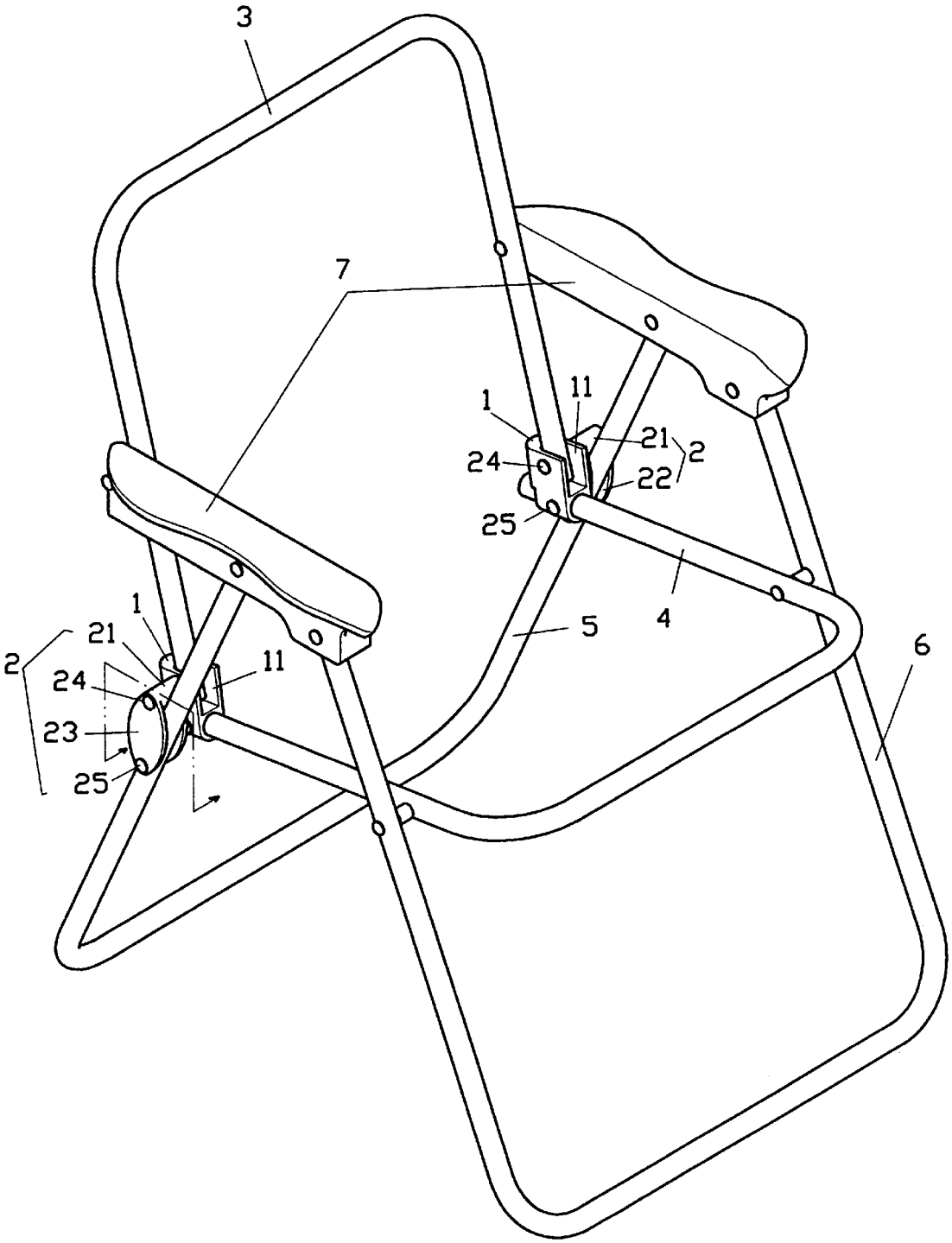
FIG. 2 is a perspective view of a folding chair incorporating the present invention.

FIG. 2 has demonstrated the assembled folding chair incorporated with the present invention, which includes the fixture 1 and the support 2, and along with a U-shaped back rod 3, a U-shaped seat rod 4, a U-shaped rear foot rod 5, a U-shaped front foot rod 6 and a pair of handles 7. Wherein the back rod 3 has its two ends inserted into two recesses 11 of two fixtures 1 and secured by the pins 24. The holes 12 (referred to FIG. 1) of the two fixture 11 are inserted with the two ends of the seat rod 4 and are also secured by two pins 25, respectively. The fixture 1 and the support 2 are so related, as shown in FIG. 3 that the pole 13 (covered by its cap 131 as shown) of the fixture 1 is inserted into the sliding guide 221 of the side wall 22 of the support 2 with its cap 131 extending outwardly therefrom.

Figure 3:
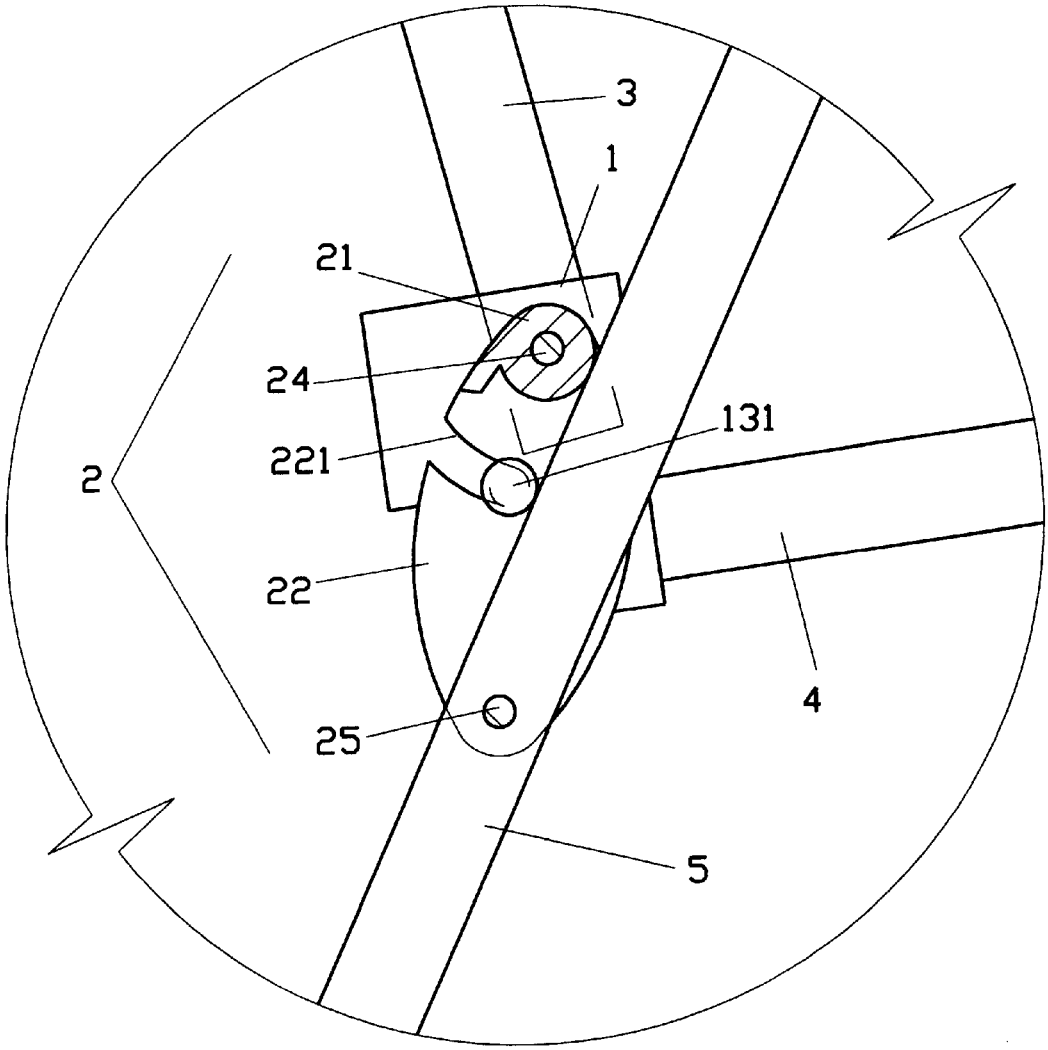
FIG. 3 is an enlarged view of the folding structure of the present invention, in an engaged position.
Figure 4:
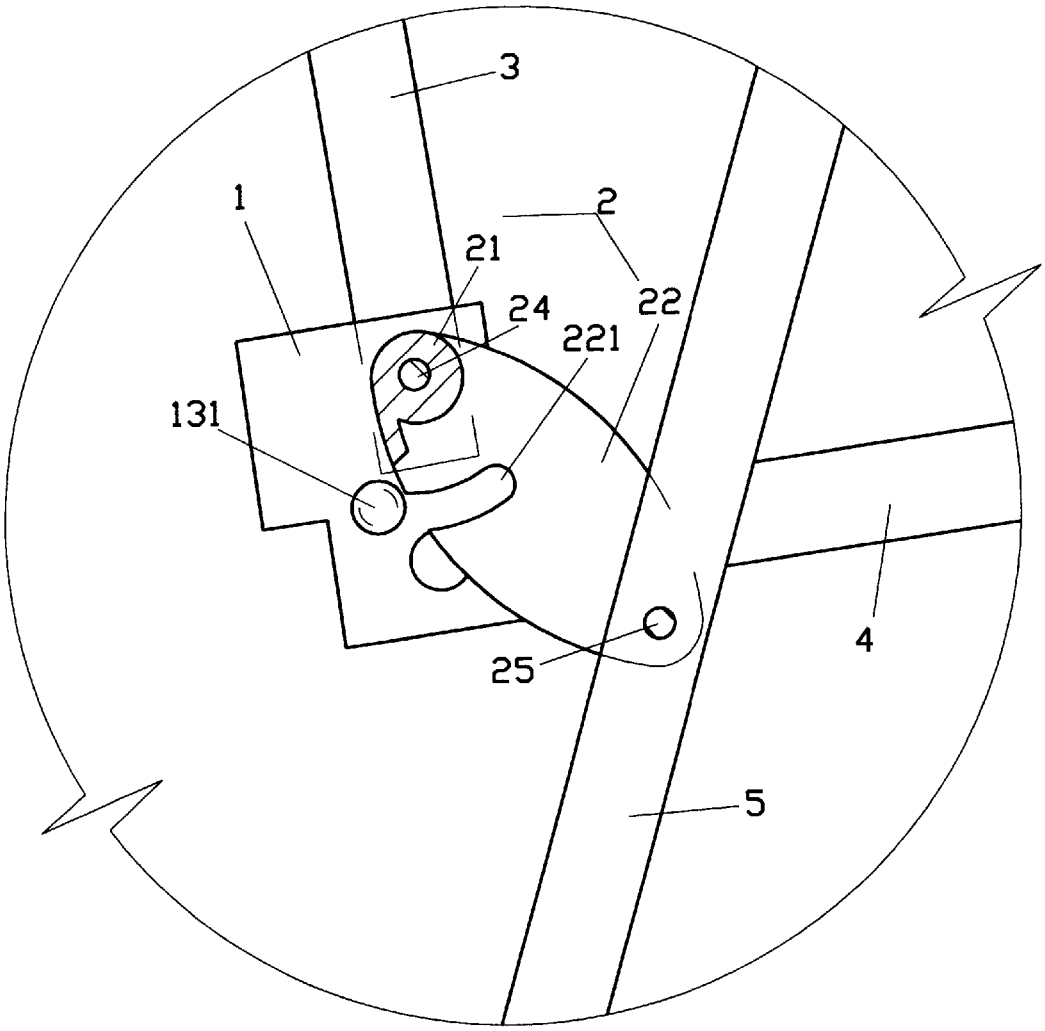
FIG. 4 is an enlarged view similar to FIG. 3 with the folding structure in a disengaged position.
Figure 5:
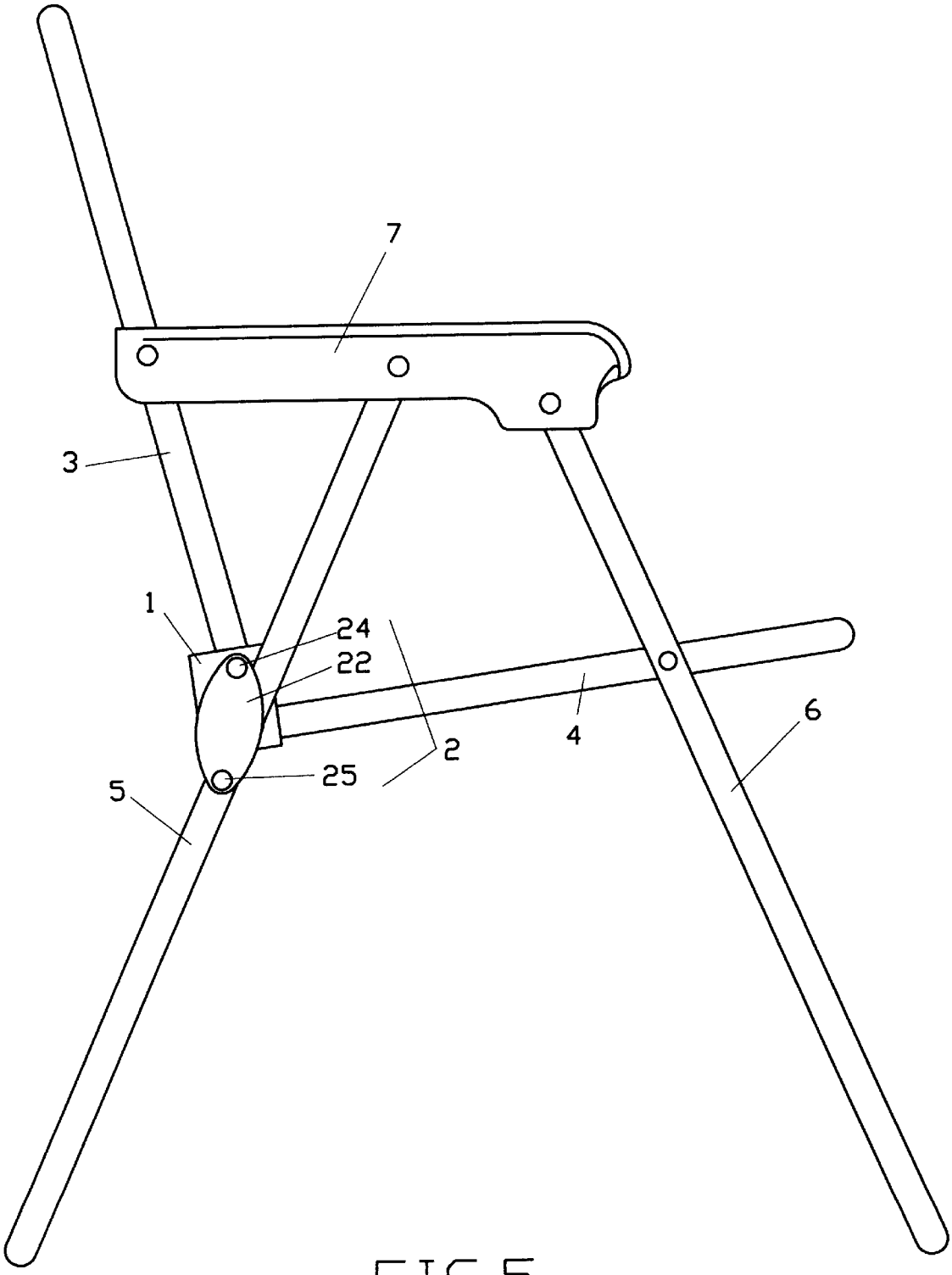
FIG. 5 is a side view of the present invention.
Figure 6:
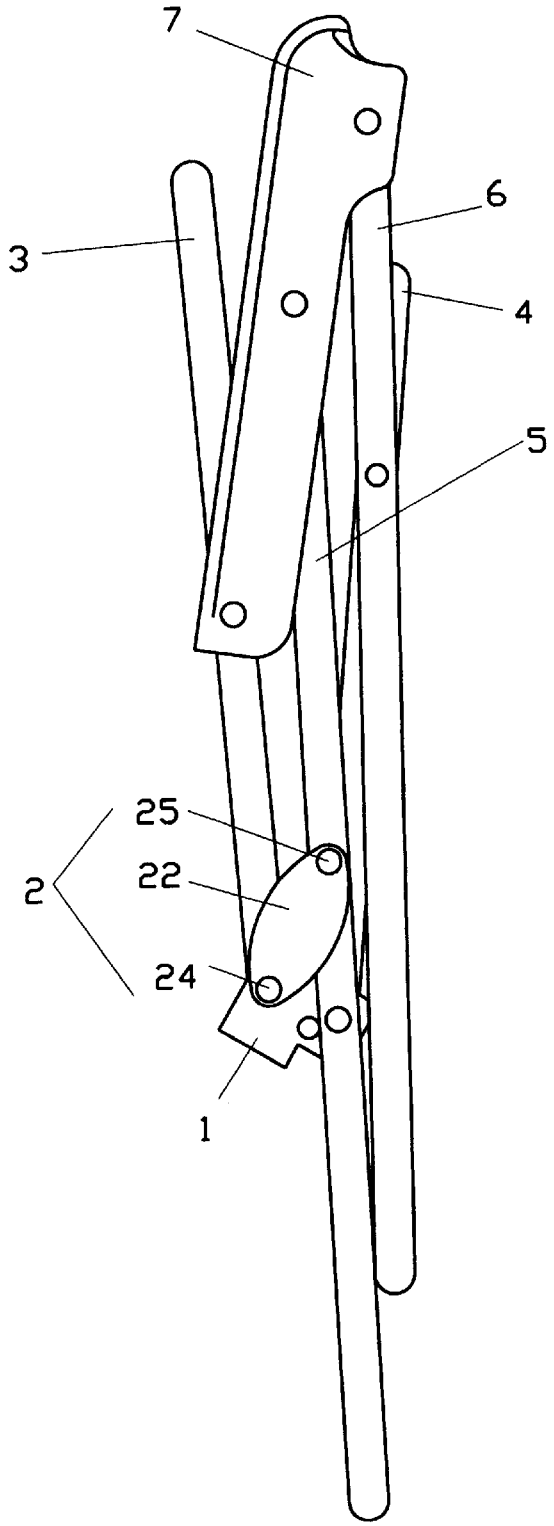
FIG. 6 is a side view showing the folding structure of the present invention a folded position.

To unfold the chair incorporated with the present invention, as shown in FIGS. 3 and 5, the fixture 1 and the support 2 are secured such that weight falls onto the support 2 through the pin 24 and the pole 13 and then the weight transferred through the support 2 to the rear foot rod 5 through the pin 25 and the stem 21. To fold the chair, as shown in FIGS. 4 and 6, the pole 13 slides outwardly from the sliding guide 221 and the back rod 3, the seat rod 4, the rear foot rod 5 and the front foot rod 6 are able to fold to its minimum.

I claim:

1. A folding chair structure comprising a fixture and a support working with a U-shaped back rod, a seat rod, a rear foot rod and a front foot rod, said fixture comprising a recess and a hole, and a pole extending from a side wall of said fixture with a cap at a far end of said pole, said support comprising a stem and two side walls, wherein said side walls being formed with an arc shaped sliding guide, thus, one of the two ends of said back rod being inserted into said recess of said fixture and said hole of said fixture being inserted with one of two ends of said seat rod, a middle portion of said rear foot rod being engaged in between said side walls and said pole being secured in said sliding guide of said side wall of said support by sliding manner in a direction parallel to said side walls.

* * * * *